US011478816B2

(12) United States Patent
Pontecorvo

(10) Patent No.: US 11,478,816 B2
(45) Date of Patent: Oct. 25, 2022

(54) MUD APPLICATOR

(71) Applicant: Gary J. Pontecorvo, Stockton, NJ (US)

(72) Inventor: Gary J. Pontecorvo, Stockton, NJ (US)

( * ) Notice: Subject to any disclaimer, the term of this patent is extended or adjusted under 35 U.S.C. 154(b) by 0 days.

(21) Appl. No.: 17/326,720

(22) Filed: May 21, 2021

(65) Prior Publication Data

US 2021/0276038 A1 Sep. 9, 2021

Related U.S. Application Data

(63) Continuation-in-part of application No. 16/448,275, filed on Jun. 21, 2019, now Pat. No. 11,047,140.

(60) Provisional application No. 62/688,508, filed on Jun. 22, 2018.

(51) Int. Cl.

| | |
|---|---|
| ***E04F 21/08*** | (2006.01) |
| ***B05C 17/00*** | (2006.01) |
| ***B05C 11/10*** | (2006.01) |
| ***B05C 11/11*** | (2006.01) |

(52) U.S. Cl.

CPC ..... *B05C 17/002* (2013.01); *B05C 11/1044* (2013.01); *B05C 11/11* (2013.01); *E04F 21/08* (2013.01)

(58) Field of Classification Search

CPC . E04F 21/08; E04F 21/06; E04F 21/16; E04F 21/02; E04F 21/023; E04F 21/026; B05C 17/002; B05C 11/1044; B05C 11/11; B05C 11/115; B05C 17/00569; B05C 17/00573; B05C 17/0054; B05C 17/015

USPC ..... 401/188 R, 261, 263, 265, 266, 289; 215/272, 273, 278, 284, 291

See application file for complete search history.

(56) References Cited

U.S. PATENT DOCUMENTS

| | | | | |
|---|---|---|---|---|
| 3,735,831 A * | 5/1973 | Gray | ..... | B62B 1/14 280/47.24 |
| 6,116,769 A * | 9/2000 | DeWall | ..... | B28C 7/163 366/65 |
| 6,779,915 B2 * | 8/2004 | Foster, Jr. | ..... | B01F 35/42 366/349 |

* cited by examiner

*Primary Examiner* — David J Walczak

(74) *Attorney, Agent, or Firm* — Gearhart Law LLC; David Postolski, Esq.

(57) ABSTRACT

A mud pumping apparatus that can be removably coupled to a container the mud was originally provided in when first obtained by the user. The mud may be mastic, mortar, grout, joint compound, spackle, or the like. The apparatus may be sized to be used with various standard sized containers, and adjustably powered and controllable to be used with different types, consistencies, and viscosities of spreadable material.

20 Claims, 13 Drawing Sheets

MUD APPLICATOR

CROSS-REFERENCE TO RELATED APPLICATIONS SECTION

This application is a U.S. Non-Provisional Patent Application and Continuation-in-Part (CIP) Application of U.S. Non-Provisional patent application Ser. No. 16/448,275 filed on Jun. 21, 2019 and patented as U.S. Pat. No. 11,047,140 on Jun. 29, 2021, which claims priority to U.S. Provisional Patent Application Ser. No. 62/688,508 filed on Jun. 22, 2018, the entire contents of which are hereby incorporated by reference in their entirety.

FIELD OF THE EMBODIMENTS

This invention relates to applicators for applying product like joint compound or mastic, commonly referred to as "mud", and in particular to an applicator apparatus that can be clamped onto an original container of the product for supply.

BACKGROUND OF THE EMBODIMENTS

New construction and remodeling projects may require installing materials such as drywall panels, wood paneling, laminate flooring, tiles for floors or walls, and the like. Such projects may require applying a layer of viscous mud-like material during installation. For example, mastic or mortar to adhere paneling or tiles to a wall or floor, or joint compound or spackle to fill spaces between drywall sheets or tiles. In the prior art, this typically included filling a hawk or mud box with the spreadable material, or filling a hopper of a powered appliance that feeds an applicator. However, prior art methods and apparatus can be difficult to master, sloppy to use, difficult to clean up a workspace and equipment after use, too expensive to buy for only occasional use, and the like.

SUMMARY OF THE EMBODIMENTS

A mud pumping apparatus that can be removably coupled to a container in which the mud was originally contained when first obtained by the user. The mud may be mastic, mortar, grout, joint compound, spackle, or the like. The apparatus may be sized to be used with various standard sized containers, and adjustably powered and controllable to be used with different types, consistencies, and viscosities of spreadable material.

It is to be understood that both the foregoing general description and the following detailed description are exemplary and explanatory and are intended to provide further explanation of the invention as claimed.

DETAILED DESCRIPTION

Figure 1:
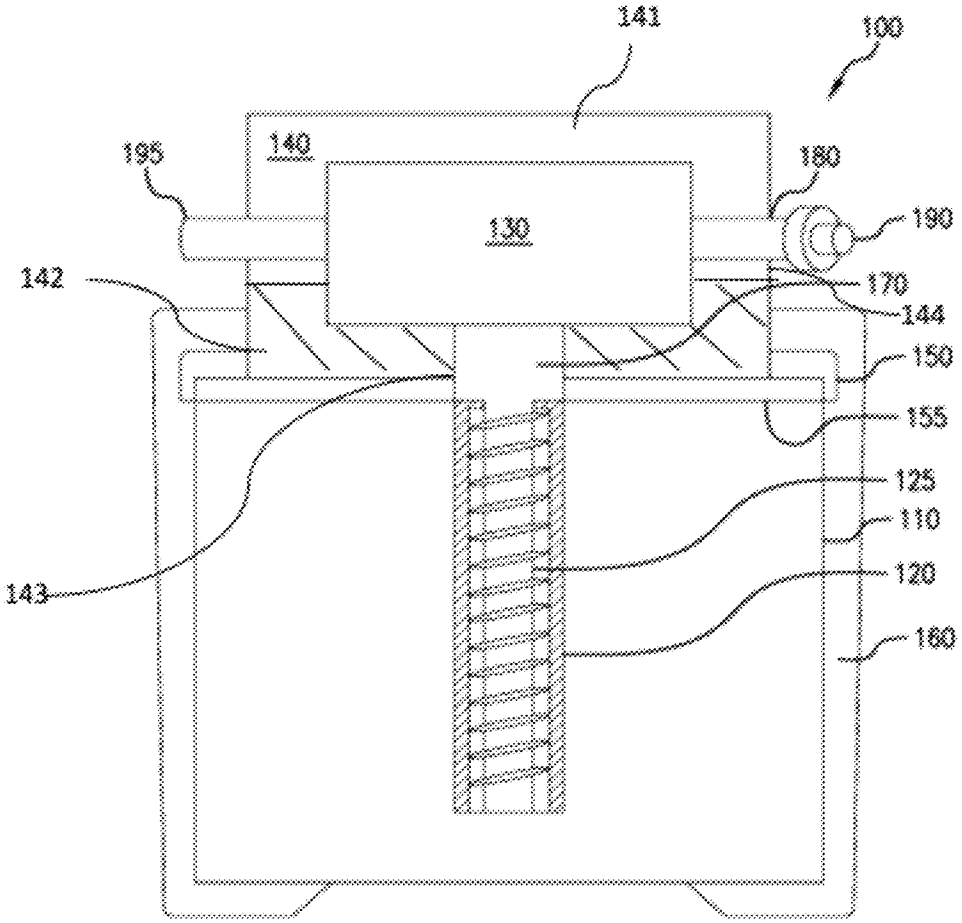
FIG. 1 is a first exemplary embodiment of a mud supply apparatus clamped to a container of mud in accordance with the disclosure.

Aspects of exemplary embodiments of the claimed invention will now be described with reference to the drawings, in which identical elements have the same reference numerals. These embodiments are provided by way of explanation of the present invention, which is not intended to be limited thereto. Those of ordinary skill in the art may appreciate upon reading the present disclosure and viewing the present drawings that various modifications and variations can be made thereto without departing from the scope and spirit of the invention. In addition, it is noted the disclosure pertains to embodiments suitable to accommodate a variety of spreadable materials, to be used in conjunction with various hoses and mud applicator heads. It will be readily understood that the components of the present invention, as generally described and illustrated in the figures herein, may be arranged and designed in a wide variety of different configurations without departing from the scope and spirit of the invention. Thus, the following detailed description of the embodiments and aspects of various apparatus and methods, and the illustrated embodiments and aspects as represented in the attached figures, are not intended to limit the scope of the invention as claimed, but are merely illustrative of selected exemplary embodiments.

FIG. 1 illustrates an embodiment of a mud ingestion system 100 removably coupled to a container 110 in which the mud was originally obtained, from a store for example. Any convenient type of power source may be used to power embodiments of the mud ingestion system, such as an alternating current (AC) outlet, a battery, liquid propane or natural gas, or compressed air. The illustrated apparatus utilizes a pump 130 with an auger type bit inside a mud pipe 120 that is inserted directly into the mud in the container 110. Other types of rotating mud movers may alternatively be used, such as a progressive cavity pump, for example. The mud pipe is configured to have a length extending from the pump inlet to a position near the bottom of the mud container when the apparatus is installed on the container.

In FIG. 1, the mud pipe is an auger tube having a circular cross section. The auger is disposed within the auger tube, coextensive with the second end of the auger tube. The auger has a helical flute inclined to convey mud from its bottom end to the inlet 170. The auger has a diameter that fits snugly within the interior diameter of the auger tube. The auger also has a central shank operatively coupled to a rotating motor shaft of the mud pump.

A central shaft 125 of the auger is connected to an electric motor or fueled engine (collectively, "motor") of the pump 130. The pump 130 is encased in a housing 140 that fits over the top of the open end of the container 110. The housing 140 has a cover portion 141 permanently affixed/attached to a bottom portion 142. The bottom portion 142 of the housing 140 forms an air-tight seal when installed onto a top of an open container of mud. Moreover, the bottom portion 142 of the housing 140 comprises an opening/hole 143 thorough which mud is drawn. The cover portion 141 of the housing 140 comprises a hole/opening 144 through which the drawn mud is pushed. In an embodiment, the bottom portion 142 of the housing 140 contains a replaceable gasket (not shown) or similar compressible impermeable material such as rubber that is pressed on and secured to the top of the container to form an air tight seal. The housing 140 may be secured, for example, with one or more clamps 150 connected to the housing 140, disposed around a circumference of the container to engage a lip 155 or the like around the circumference of the container. Alternatively or in addition, straps 160 may be clamped around the bottom of the container, or clamped to an edge around a bottom circumference of the container. The clamps 150, straps 160, or the like, may be adjustable to provide for the housing 140 to be pressed against the top of the container when the apparatus is installed thereon, to make an air tight seal. The clamps 150 may also be replaceable.

The pump and housing have an inlet 170. As the pump 130 runs, the mud is drawn into the bottom end of the mud pipe and conveyed to inlet 170. The mud passes through the pump 130 and out of the outlet 180, where it is fed into an applicator feed tube (not shown). The outlet 180 is terminated in an outlet coupling device 190 of any appropriate type known in the art. In an embodiment having a flexible feed tube and applicator head components, a first end of the feed tube has a surface configured to match a surface of the container outlet coupling device 190. This matching pair of surfaces can be pushed or screwed together make an air tight seal. Likewise, the applicator head can have a surface configured to match a surface of the other end of the feed tube, to be pressed or screwed onto that end to make another air tight seal.

The matching surface pairs (i.e., an end of the feed tube coupled to the outlet coupling device 190, and the other end of the tube coupled to a connector on the applicator head) are configured with matching surfaces to make their respective air tight seals. There are a variety of matching surfaces that can be used to couple the components together, including ribbed, threaded, and smooth surfaces with a latching element to prevent the surfaces from decoupling. In embodiments, either of the coupling components may be configured as a male end, to be inserted into a matching female end of the other component being joined.

Figure 2:
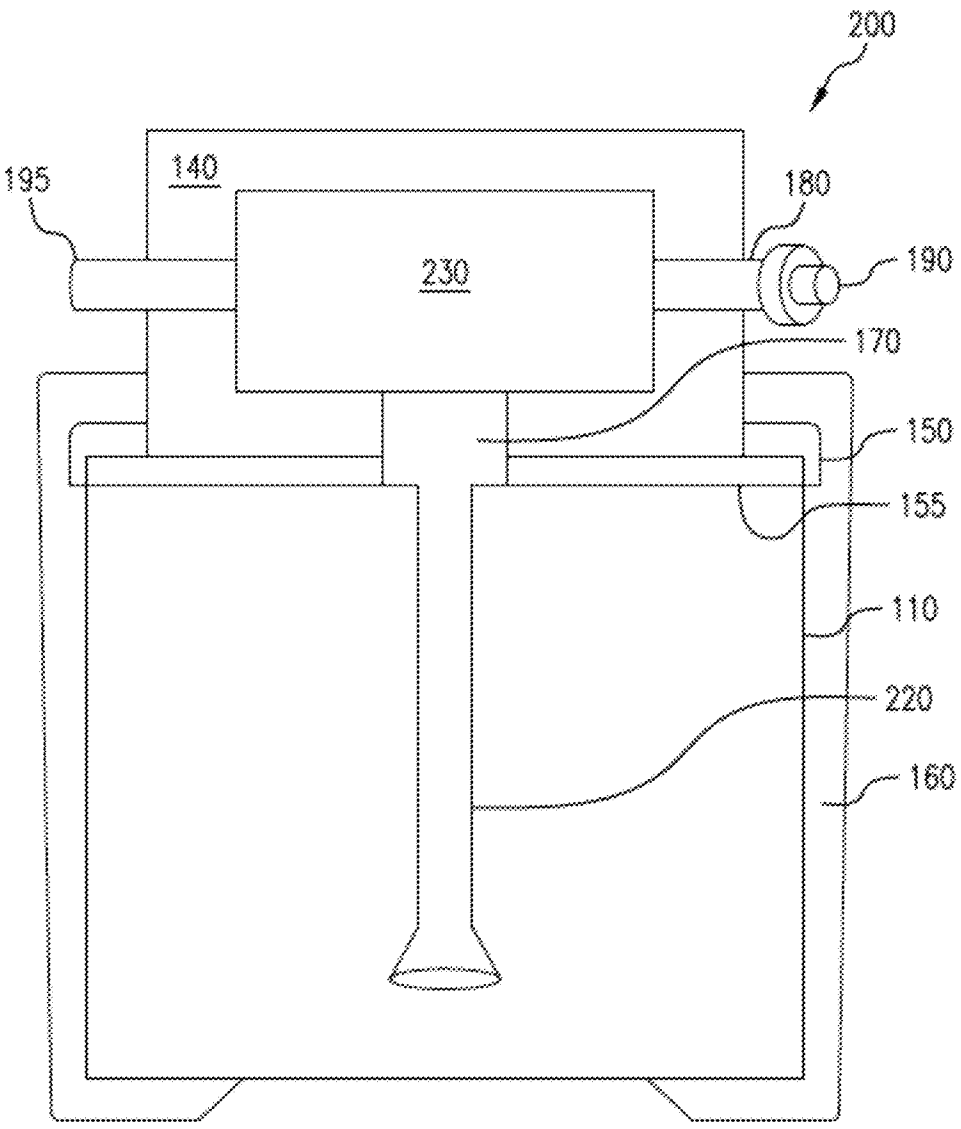
FIG. 2 is a second exemplary embodiment of a mud supply apparatus clamped to a container of mud in accordance with the disclosure.

FIG. 2 illustrates an embodiment of a mud ingestion system 200 that is substantially similar in many ways to that of FIG. 1. The differences have to do with the mechanism by which the mud is conveyed through the system. In particular, the mud pipe can be configured as a siphon 220 that sucks mud from near the bottom of container 110, and conveys the mud through the inlet 170 and the pump 230 and out of outlet 180. The siphon is connected to the pump 230, which is encased in housing 140. In this exemplary embodiment, the pump may be a centrifugal pump, for example. As before, the housing 140 is secured to the top of the container 110 to form a seal around the top of the container, with clamps 150 that connect to the housing, disposed around a circumference of the container, or straps 160 that are clamped to the bottom of the container, or both. The clamps 150 or straps 160, or both, are adjustable to allowing for the housing 140 to be fully sealed against the top of the container 110, making an air tight seal.

As the pump 230 runs, mud is sucked into the inlet 170 and pumped out of the outlet 180, where it is fed into the feed tube (not shown). The outlet 180 is again terminated in a coupling device 190 of any appropriate type known in the art, to which an applicator feed tube is coupled.

Figure 3:
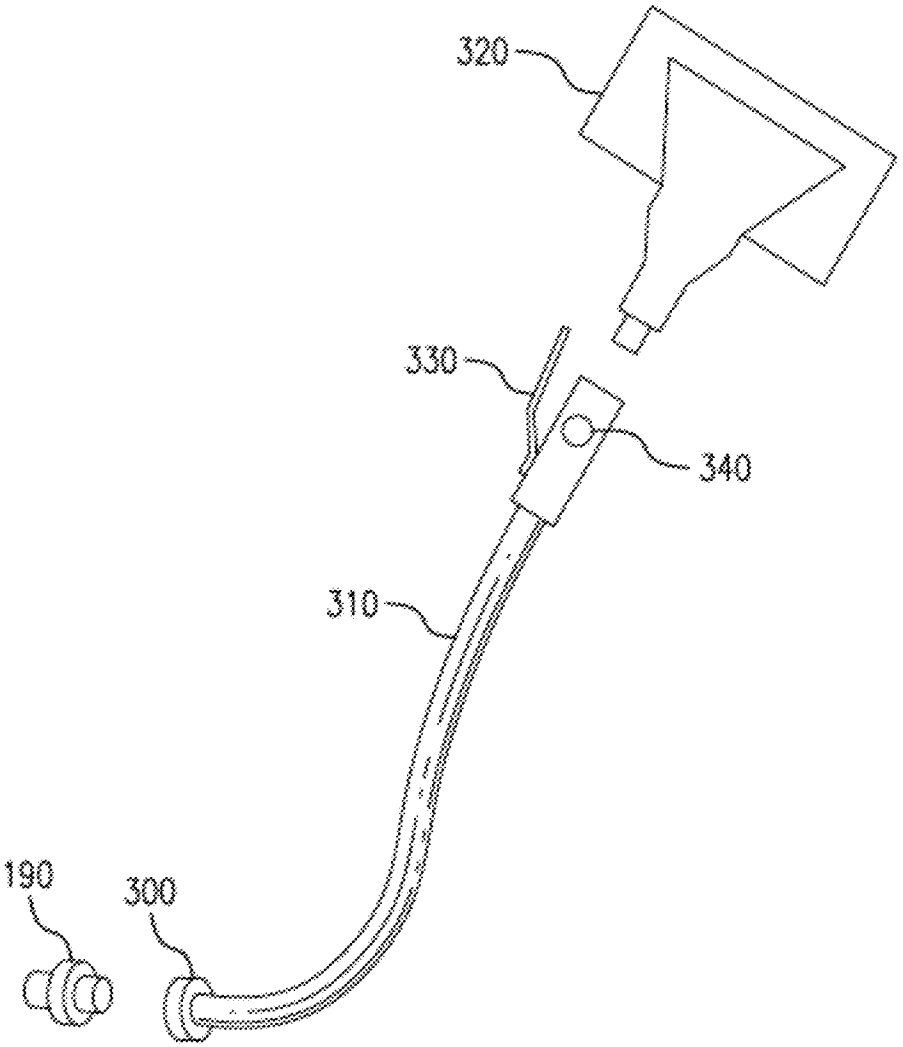
FIG. 3 is an exploded view of an exemplary mud applicator, comprising a feed tube and an applicator head.

As illustrated in FIGS. 1 and 2, in embodiments a mud ingestion system outlet tube 180 may terminate at one end in a coupling device 190 configured to connect to a matching coupling device of an applicator arm to form an air tight seal. Referring now to FIG. 3, coupling device 190 is coupled to matching coupling device 300 of an exemplary applicator feed tube 310. During operation mud is fed from the mud ingestion system outlet into the applicator feed tube 310 coupled thereto, to an applicator head 320, through which the mud is extruded onto a work surface. As noted, in embodiments the feed applicator tube 310, applicator head 320, or both, may be attached to a handle 330 that the user can use to control the placement of the mud onto the work surface.

In embodiments, the pump may be activated and controlled by an on/off control switch 340. The control switch may be placed at any convenient location, such as on or next to the applicator handle 330, or on the feed tube 310, or on the applicator head 320. The pump may be continually or intermittently activated by operating the control switch, which may be combined with the on/off switch 340 as shown, or may be separate from the on/off switch. In embodiments, variable controller 340 may be used to control the speed at which mud is taken up from the container and extruded from the applicator head 320. In embodiments, the control switch may be operatively coupled to the pump using a wireless connection such as a radio frequency (RF) interface, such as a wife or Bluetooth compliant connection, to send control or other signals to or from the pump. Alternatively, the control switch may be operatively coupled to the pump using a wired connection (not shown), in which the wires may be run along the feed tube 310, for example. In embodiments, two or more feed lines may be supplied by a single mud ingestion system. Preferably, each line may be supplied with its own control switch.

In embodiments, the pump 130 and housing 140 may also comprise an inlet with a threaded end, 195. A water hose may be connected to the inlet 195 so that, as mud is drawn through the pump 130, the viscosity of the mud may be modified by adding a desired amount of water to the mud at the pump. In such an embodiment, the control switch may operate a valve disposed inside or adjacent to the inlet 195 as the pump is controlled. The valve may be activated together with the pump. In embodiments, the control switch may be further configured and arranged to modify the valve opening independently of the pump, to modify the percentage by weight of water in the mud-water mixture as the pump operates, to better adjust the viscosity of the mixture as the mud and water flow through the pump.

Different types of applicator heads 320 can be attached to the feed tube 310, suitable for different types of mud and different applications. The different types of applicator heads may provide a flow rate, extrusion shape, and distribution of mud appropriate for a particular application. For example, an applicator head that extrudes mud to have parallel groves can be used to spread an adhesive compound for use in installing tile, wherein the grooves aid in drying the adhesive and securing the tiles to the work surface. In another example, the applicator head can extrude a smooth, flat layer of joint compound to fill joints and cover tape between dry wall panels to create a uniformly flat wall surface. Other applicator heads may alternatively be used, configured for use in different applications.

Figure 4:
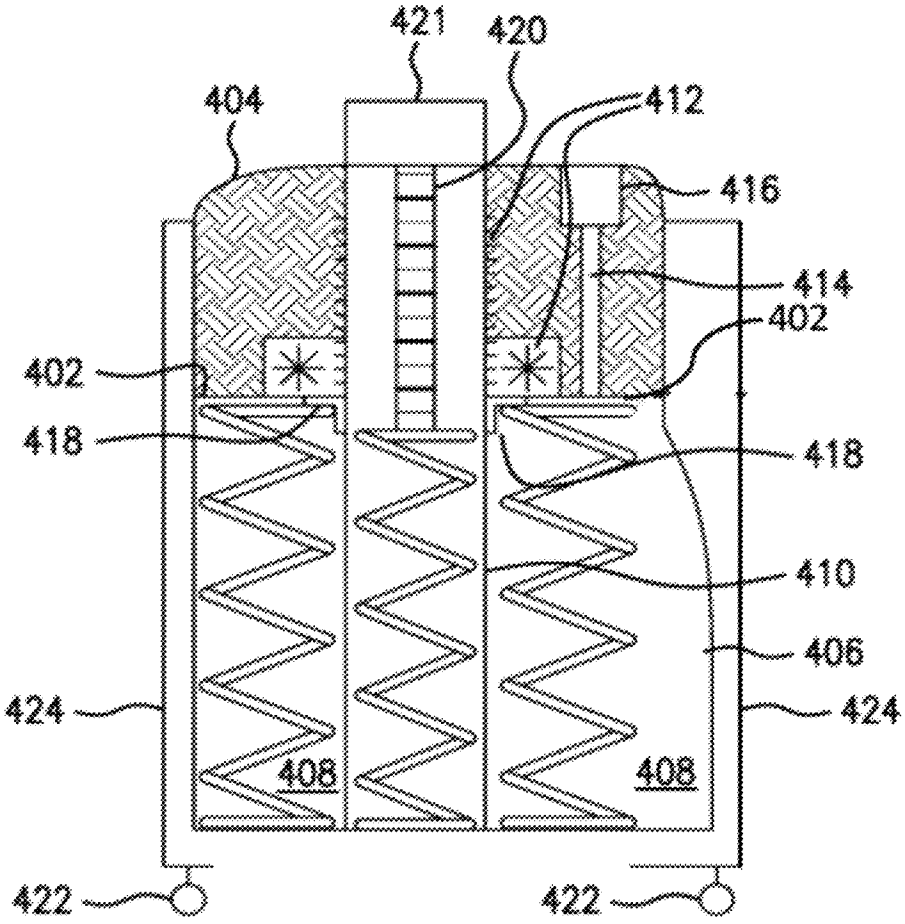
FIG. 4 is an exemplary embodiment of a mud supply apparatus including a piston to provide positive pressure to the mud being pumped, in accordance with the disclosure.

In embodiments, as illustrated in FIG. 4, wheels 422 can be secured to the bottom of the mud container by supporting straps 424. The wheels may be placed under the mud container so the container may be wheeled while the system is being used. In embodiments, a feed line holder (not shown) may be coupled to the feed line that attaches to the operator's belt or waist to carry some of the weight of the loaded feed line. This would be especially useful when applying mud above the level of the operator.

In embodiments, an auxiliary system that works in conjunction with the mud ingestion system previously described may be included that provides a positive flow of mud from within the bucket to the mud pump. One such embodiment is illustrated in FIG. 4, in which a flat piston type system initially has the piston 402 at the top of the motor housing 404 or top of the bucket of mud 406. The piston is pushed downward into the bucket against the mud 408 to push the mud into the mud ingestion system as the mud ingestion system is operated. The piston 402 is shaped to fit snugly within the inside surface of the bucket 406, and has an opening through which the mud pump inlet tube 410 slides, typically along the central axis of a right circular cylindrical shaped bucket. In an embodiment, a flange 418 can be included between the piston opening and the outer casing of the mud pump inlet tube 410 that slides against the outer casing of the pump inlet tube to prevent mud from leaking around the tube as the piston 402 presses against the mud.

In embodiments, the piston 402 may turn clockwise or counter clockwise as it moves downward into the bucket, or it may not rotate as it moves. In embodiments, the piston may slide directly against the smooth outer casing of the mud pump tube, or may slide along matching inter-meshing grooves 412 in the opening of the piston and the outer casing of the mud pump tube. This may help guide the piston to move straight down to the bottom of the bucket as it is pushed against the mud. The piston may be pushed downward into the bucket in a straight non-screwing motion by extendible or fixed arms 414 extending from a piston motor 416 to the top of the piston 402. These are arranged to push the piston down into the bucket via gearing, hydraulics, or other means known in the art.

In other embodiments, the piston 402 may be configured to be screwed down into the bucket along the inter-meshing grooves 412 in a screw-like configuration, similar to a bolt and nut, the bolt being the outer surface of the mud pump inlet tube 410 and the nut being the piston 402. The piston may be pushed downward into the bucket in a circular screwing motion by extendible or fixed arms 414 extending from a piston motor 416 to the top of the piston 402. These are arranged to push the piston down into the bucket via gearing, hydraulics, or other means known in the art.

Another auxiliary system embodiment that works in conjunction with the mud ingestion system previously described includes a flat piston embodiment with motor(s) and interlocking teeth/gears in the straight down or screwed down motion. The piston can be pushed downward into the bucket in a straight motion by providing the piston with an outer casing and piston shaft having teeth on one or more sides which intermesh with the teeth of one or more motors. When the motor(s) are activated in conjunction with the mud ingestion system, the piston is pushed down into the bucket by the gearing action of the intermeshing teeth in a downward motion. In embodiments, the piston can be pushed in a downward screwing motion into the bucket by providing the piston outer casing and piston shaft with screw threads that intermesh with screw threads of one or more motors. When the motor(s) are activated in conjunction with the mud applicator, the piston is screwed down into the bucket by the screw gearing action of the intermeshing screw threads.

Alternatively, the mud pump inlet tube 410 may itself be turned by a motor of its own in a clockwise or counter clockwise direction. In such an embodiment, the piston 402 may slide straight down against the mud pump inlet tube 410, similar to a bolt and nut arrangement with the bolt turning and the nut remaining stationary. The piston 402 may be pushed down into the bucket by gearing, hydraulics or other means emanating from a motor system. A second inner casing may encase the mud pump inlet tube 410, allowing the auger bit 420 to be in a tube during the activation of the mud applicator. In an embodiment, the outer casing/piston shaft can be fixed in place and the flat piston can be screwed down into the bucket by gearing, hydraulics or other means emanating from the motor system. In another embodiment, the auger bit can be screwed down to the bottom of the bucket at the time the mud ingestion system is installed on the mud bucket. As the mud ingestion system is operated, the auger bit 420 is simultaneously turned and pulled in an upward motion by auger bit motor 421. The upward motion of the auger bit 420 causes mud to be pushed up against the bottom of the motor housing (at the top of the bucket) and fed at a constant rate into the pump inlet as the auger bit rotates.

Figure 5:
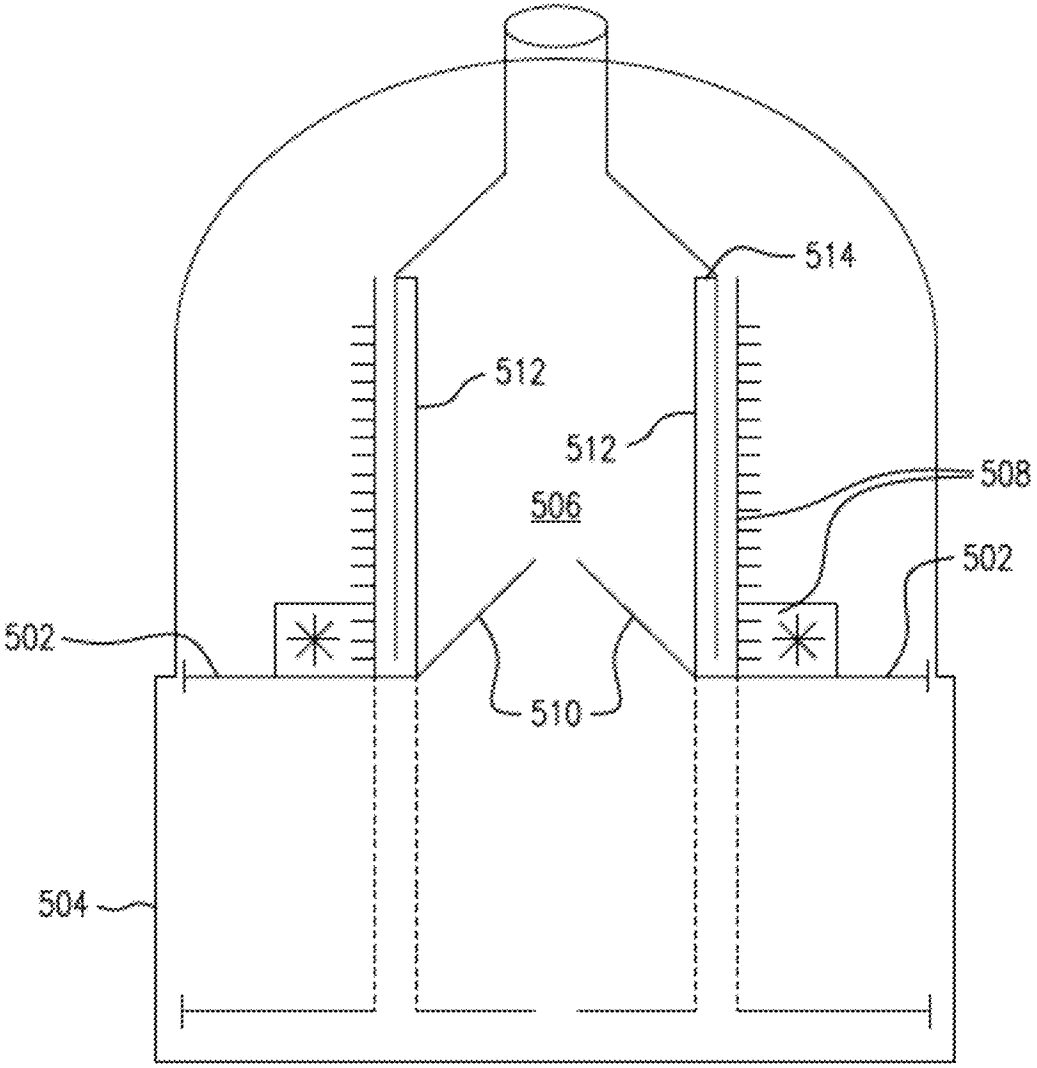
FIG. 5 is another exemplary embodiment of a mud supply apparatus including a piston to provide positive pressure to the mud being pumped, in accordance with the disclosure.

Another auxiliary system embodiment that works in conjunction with a mud ingestion system is illustrated in FIG. 5. Similarly to the auxiliary system embodiment illustrated in FIG. 4, a piston 502 pushes mud from its original container 504 to a feed chamber 506, with inter-meshing grooves 508 or the like guiding the piston 502 downward. However, in this embodiment, piston 502 is coupled to piston feed chamber sleeves (PFCS) 512 that are initially disposed against the walls of the feed chamber 506. As the piston 502 pushes the mud in the mud container 504 down, the PFCS 512 also descend into the mud container, extending downward to the bottom of container 504.

The PFCS 512 may have feed chamber closing flaps 510 coupled to the bottom of each side of the PFCS. The feed chamber closing flaps 510 may move from horizontal (perpendicular to each PFCS) to vertical when they lay flat against the PFCS. The chamber closing flaps 510 lay vertically against the PFCS when the piston 502 is pushed down into the container 504 and the mud is pushed up into the feed chamber 506. Conversely, after the piston reaches the bottom of the mud container and mud resides only in the feed chamber, the piston may be pulled up in the container 504. This causes the chamber closing flaps 510 to close, sealing the bottom end of the feed chamber 506, and causing the mud still contained in the feed chamber 506 to be pushed toward the top of the feed chamber and out of the mud outlet 180.

In embodiments, the chamber closing flaps 510 can be replaced with a feed chamber sealing plate pushed into place by a motor and interlocking teeth (not shown), that operate on the top side of the piston.

Figure 6:
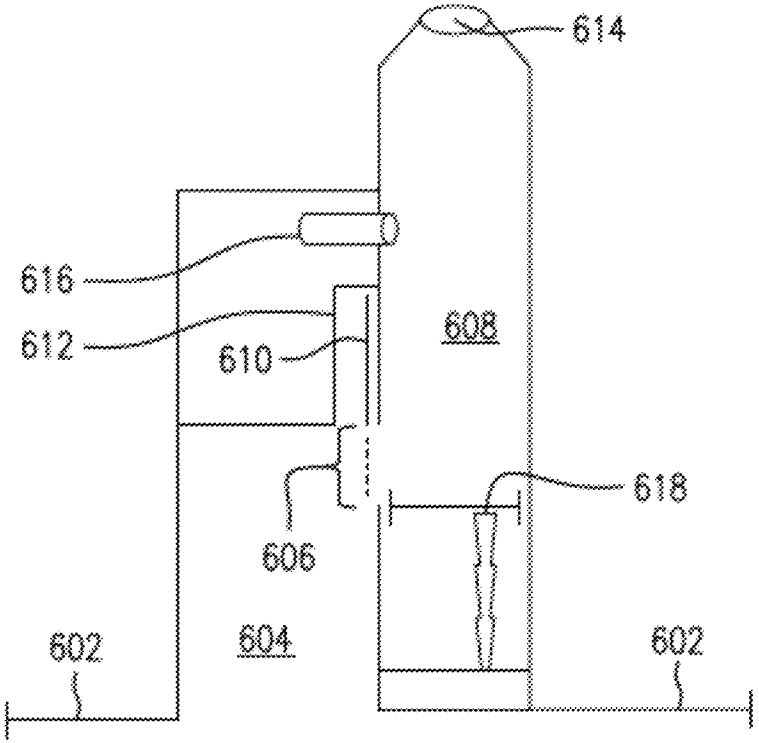
FIG. 6 is yet another exemplary embodiment of a mud supply apparatus including a piston to provide positive pressure to the mud being pumped, in accordance with the disclosure.

FIG. 6 illustrates another embodiment, activated by a trigger at the end of the feed line (not shown). This embodiment has a first pump chamber 604 having an opening 606 to a second pump chamber 608. A chamber separator 610 is disposed therebetween, slidable between an open position in which the chamber separator 610 resides in housing 612 and leaves the opening 606 uncovered, and a closed position (represented by a dotted line adjacent to opening 606) that covers and closes opening 606. When the system is activated, the chamber separator 610 remains in its open position as piston 602 is pushed down into the mud container, pushing mud into the first pump chamber 604, through the opening 606 and into the second pump chamber 608 to a feed tube opening 614. When the mud reaches the feed tube opening 614, pressure builds up in the second pump chamber 608. A pressure sensor 616 detects the elevated pressure, and sends a signal to a driver of chamber separator 610 (not shown), causing the chamber separator 610 to slide to its closed position.

Thereafter, at each trigger pull the pump piston 618 is activated and pushes the mud in the second pump chamber through the feed tube opening 614 and into the feed line to the mud applicator. When the pump piston 618 reaches the top of the second pump chamber 608 a contact/sensor (not shown) will activate, causing a pump piston driver (not shown) to return the pump piston 618 to the bottom of the second pump chamber 608, and at the same time causing the chamber separator 610 to return to its open position within its housing. Until these operations are completed, the trigger may also be deactivated, and mud will stop being dispensed.

Thereafter, the piston motor independently or upon activation of the trigger will reactivate the piston 602, pushing it further down into the mud container to push more mud into the first pump chamber 604, and continuing the cycle just described. When the piston 602 reaches the bottom of the mud container, mud still resides in the first and second feed chambers. The bottom of the first feed chamber 606 may then be sealed to retain the mud in the feed chambers 604, 608 as the piston 602 is lifted by its motor back up to the top of the mud container. The first feed chamber 604 can be sealed in any convenient manner. For example, feed chamber closing flaps (not shown in FIG. 6) may be attached to the bottom of the walls of the first feed chamber. The closing flaps may be pushed flat against the chamber walls as mud is pumped into the chamber, and pulled down again as piston 602 is raised, as described in connection with FIG. 5. Alternatively, a feed chamber closing plate (not shown) may be activated to seal the feed chamber opening.

In embodiments, the feed lines and the mud applicators may be provided with one or more air release valves (not shown), to allow air being pushed through the feed line to escape during priming of the feed line, filling the mud applicator with mud only.

The disclosed embodiments can be used to supply tile grout, mortar, mastic, joint compound, or other premixed material of similar consistency and flow properties, directly from the original container. The flowing materials may be obtained pre-mixed in their container, or may be mixed in their container, and applied using the apparatus.

After use, if the entire contents of the container have not been applied and will be used again within a reasonably brief amount of time, such as within a day or two, or perhaps more depending on the flowing material being used. The air tight seal between the apparatus and the container will maintain the proper consistency of the material as effectively as if the apparatus was removed from the container, and the lid of the container replaced. The material inside the feed tube may also be maintained in a similar condition by removing the applicator head and sealing the end of the feed tube. The applicator head should generally be washed between uses. This practice may give acceptable results for brief periods of time between uses. However, for a somewhat longer period of time between uses, such as several days, the feed tube should also be removed from the outlet coupling device 190 and outlet 180 sealed at the coupling end. This will store the material within the original storage bucket and the motor housing. The feed tube may then also be cleaned.

In embodiments, at the end of use until the next day or longer thereafter, the applicator may be disconnected from the feed line and washed clean with water or other solvent if appropriate, depending on the type of mud material that was extruded. Mud remaining in the feed line can be pushed back into the feed chamber by inserting a feed line cleaning rod (not shown) into the feed line. The feed line cleaning rod fits snugly inside the feed line, with just enough spacing to allow it to be pushed into the feed line. The feed line cleaning rod may be pushed into the feed line until it reaches the end of the feed line where it is coupled to the motor housing. This pushes the mud remaining in the feed line back into the feed chamber.

When finished using the disclosed apparatus, water or other appropriate cleaning agent may be run through the entire apparatus, feed tube, and applicator head for cleaning. Moreover, embodiments having one or more piston feed chamber sleeves can include chamber scrapers on the top of the chamber sleeves, to scrape and prevent mud from clogging space between the flat piston feed chamber sleeves and the feed chamber walls. In an embodiment, the end of the mud tube may advantageously be configured to be coupled to a threaded hose connector. A water hose can then easily provide water to flush through the apparatus, feed tube, and applicator head in a single operation. Alternatively or in addition, a water hose can be coupled to the housing inlet 195 to clean the apparatus.

It is noted that prior art mud appliances generally require the mud to be removed from its original container and placed into a holding tank of the appliances. Other prior art approaches may require manual solutions such as placing mud in a mud box or on a hawk and, using a trowel with a handle or pole affixed to it, spread the mud by drawing the trowel across the work surface, such as a wallboard, floor board, or like surface.

Advantages of the disclosed apparatus include that the mud (spackle, joint compound, adhesive, etc.) is not removed from its original container prior to use, unlike prior art practices. Moreover, the mud can be stored for reasonably short periods in its original container with the apparatus installed, such as to continue a job in progress the next day. Further, the disclosed apparatus does not rely on gravity as a mud mover. Instead, it is fed using a powered auger tube or suction pipe. The apparatus can be manufactured in various sizes to accommodate various standard size containers, commonly 1 lb., 2 lb., 3.5 lb., 4 lb., or 5-lb. containers, although other sizes may also be accommodated. The container contents may be measured by volume or by weight, using metric, imperial, or other measuring bases. In embodiments, the disclosed apparatus can be transported in one piece, with or without being installed on a mud container.

Figure 7:
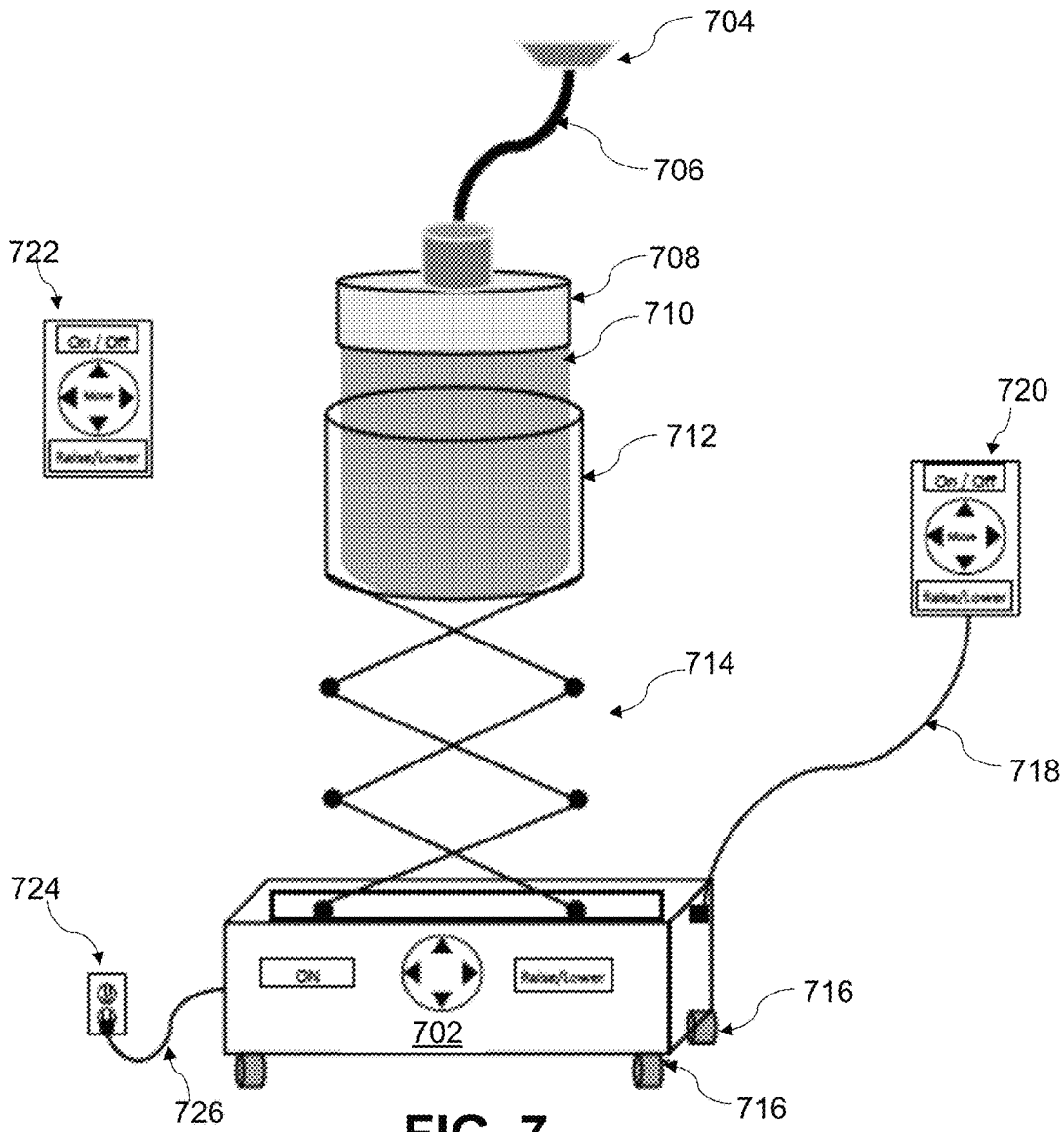
FIG. 7 depicts an exemplary embodiment of a mud supply apparatus that includes an interlocking scissor arms component, in accordance with the disclosure.

FIG. 7 depicts an exemplary embodiment of a mud supply apparatus that includes an interlocking scissor arms component, in accordance with the disclosure. The mud supply apparatus of FIG. 7 includes numerous components, such as: an applicator head 704, a hose 706 connecting the applicator head 704 to a mud applicator 708, a spackle bucket with mud 710, a cylindrical container 712, an interlocking scissor arms component 714, a motor base 702, a first cord 726 connecting the motor base 702 to an electrical outlet 724, locking wheels 716, a second cord 718 connecting the motor base 702 to a wire harness controller 720, and a wireless controller 722. The interlocking scissor arms component 714 is an example of a movement component of the motor base 702. The locking wheels 716 may be configured to move the motor base 702 to a desired location and may include a locking mechanism to maintain a position of the motor base 702. In some examples, the motor base 702 may be motorized, allowing the motor base 702 to be moved to the desired location, while an operator is on scaffolding or a ladder.

The cylindrical container 712 holds the spackle bucket with mud 710. The mud applicator 708 is associated with or affixed to the spackle bucket with mud 710. The cylindrical container 712 may be raised and lowered by operation of the wireless controller 722. In some examples, a wired controller may be used to raise or lower the cylindrical container 712. As shown in FIG. 7, the interlocking scissor arms component 714 stacks unopened on the top of the motor base 702 and expands to an open position to lift the cylindrical container 712, the spackle bucket with mud 710, and the mud applicator 708. This configuration allows the operator to be located on a ladder or scaffolding and operate the remote/button to raise and lower the spackle bucket with mud 710 to allow spackling higher areas.

Figure 8:
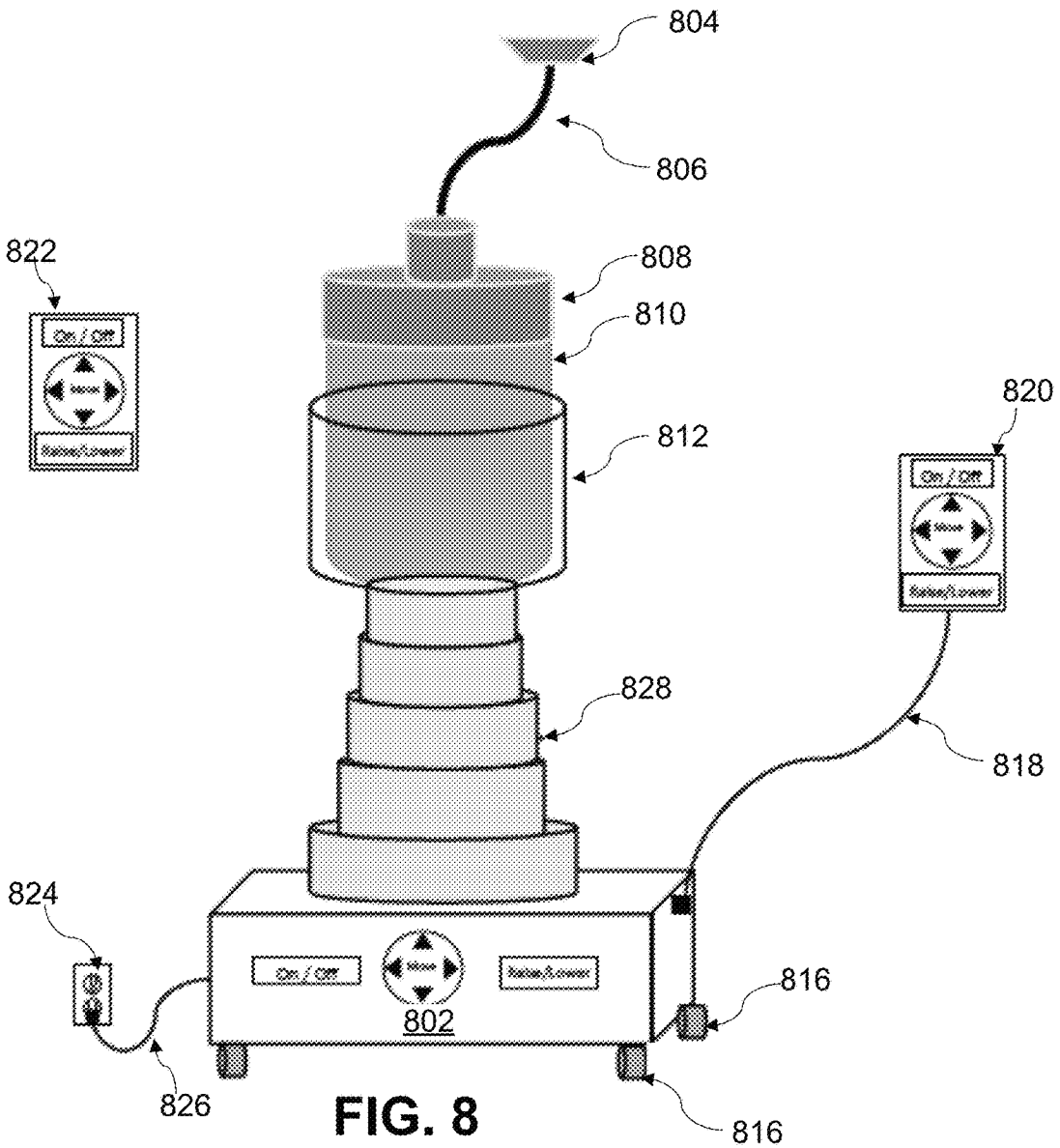
FIG. 8 depicts an exemplary embodiment of a mud supply apparatus that includes a telescoping component, in accordance with the disclosure.

FIG. 8 depicts an exemplary embodiment of a mud supply apparatus that includes a telescoping component, in accordance with the disclosure. FIG. 8 includes substantially similar components as in FIG. 7. For example, the mud supply apparatus of FIG. 8 includes: an applicator head 804, a hose 806 connecting the applicator head 804 to a mud applicator 808, a spackle bucket with mud 810, a cylindrical container 812, a telescoping component 828, a motor base 802, a first cord 826 connecting the motor base 802 to an electrical outlet 824, locking wheels 816, a second cord 818 connecting the motor base 802 to a wire harness controller 820, and a wireless controller 822. The locking wheels 816 may be configured to move the motor base 802 to a desired location and may include a locking mechanism to maintain a position of the motor base 802. The telescoping component 828 is an example of the movement component of the motor base 802.

The cylindrical container 812 holds the spackle bucket with mud 810. The mud applicator 808 is associated with or affixed to the spackle bucket with mud 810. The cylindrical container 812 may be raised and lowered by operation of the wireless controller 822. In some examples, a wired controller may be used to raise or lower the cylindrical container 812. As shown in FIG. 8, the telescoping component 828 (e.g., the movement component of the motor base 802) expands and contracts to raise and lower the cylindrical container 712, the spackle bucket with mud 710, and the mud applicator 808. This configuration allows the operator to be located on a ladder or scaffolding and operate the remote/button to raise and lower the spackle bucket with mud 810 to allow spackling higher areas.

It should be appreciated that, in some examples, the interlocking scissor arms component 714 of FIG. 7 and the telescoping component 828 of FIG. 8 may be raised or lowered by a switch on the unit (e.g., the motor base) itself. In other examples, another individual may engage the wireless controller 722 or the wireless controller 822 to raise or lower the cylindrical container 812.

Figure 9:
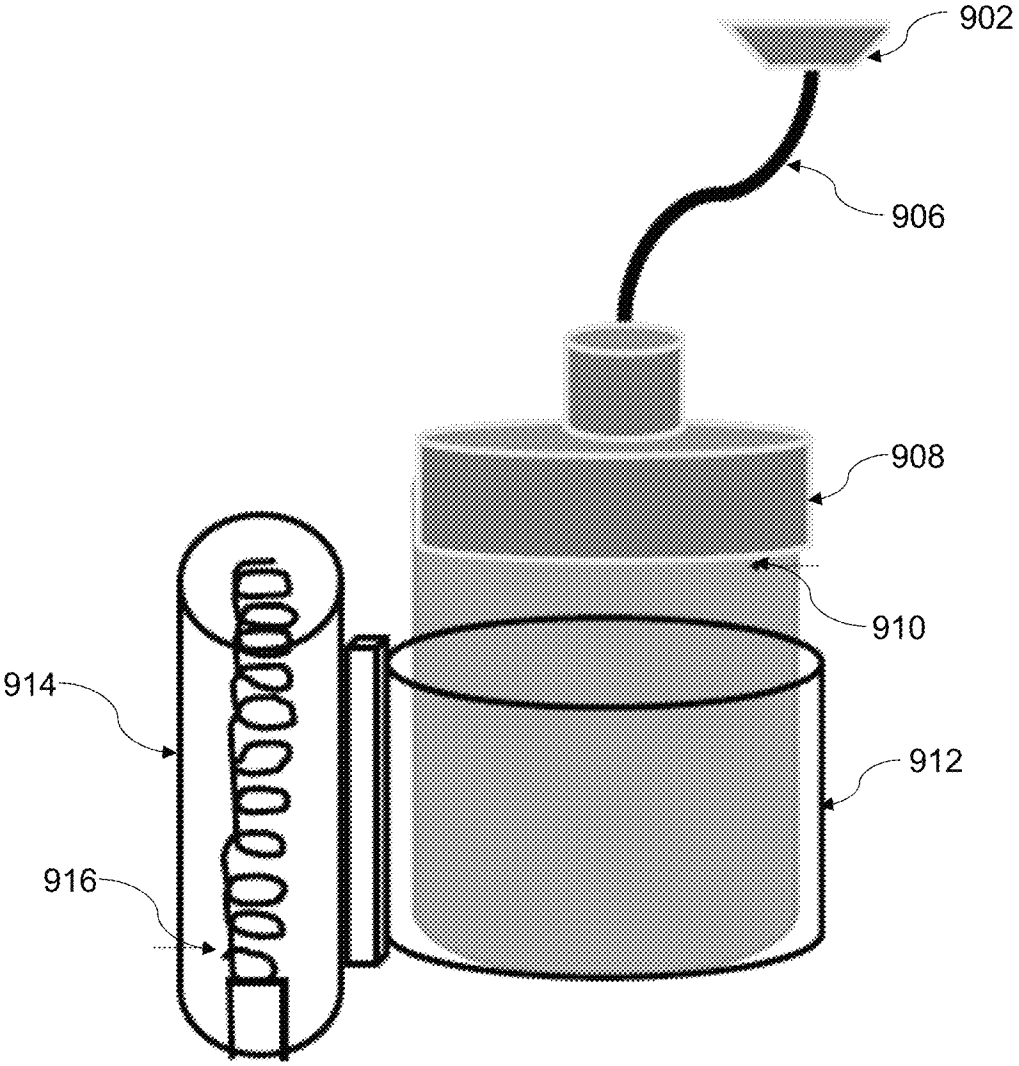
FIG. 9 depicts an exemplary embodiment of a mud supply apparatus that comprises a lift sleeve, in accordance with the disclosure.

FIG. 9 depicts an exemplary embodiment of a mud supply apparatus that comprises a lift sleeve, in accordance with the disclosure. The mud supply apparatus of FIG. 9 includes numerous components, such as: an applicator head 902, a hose 906 connecting the applicator head 902 to a mud applicator 908, a spackle bucket with mud 910, a cylindrical container 912, a lift sleeve 914, and a screw device 916. The lift sleeve 914 moves vertically along the screw device 916, as it is threaded internally to match with threads of the screw device 916. The lift sleeve 914 is connected to the cylindrical container 912 that holds the spackle bucket with mud 910, with the mud applicator 908 attached.

Figure 10:
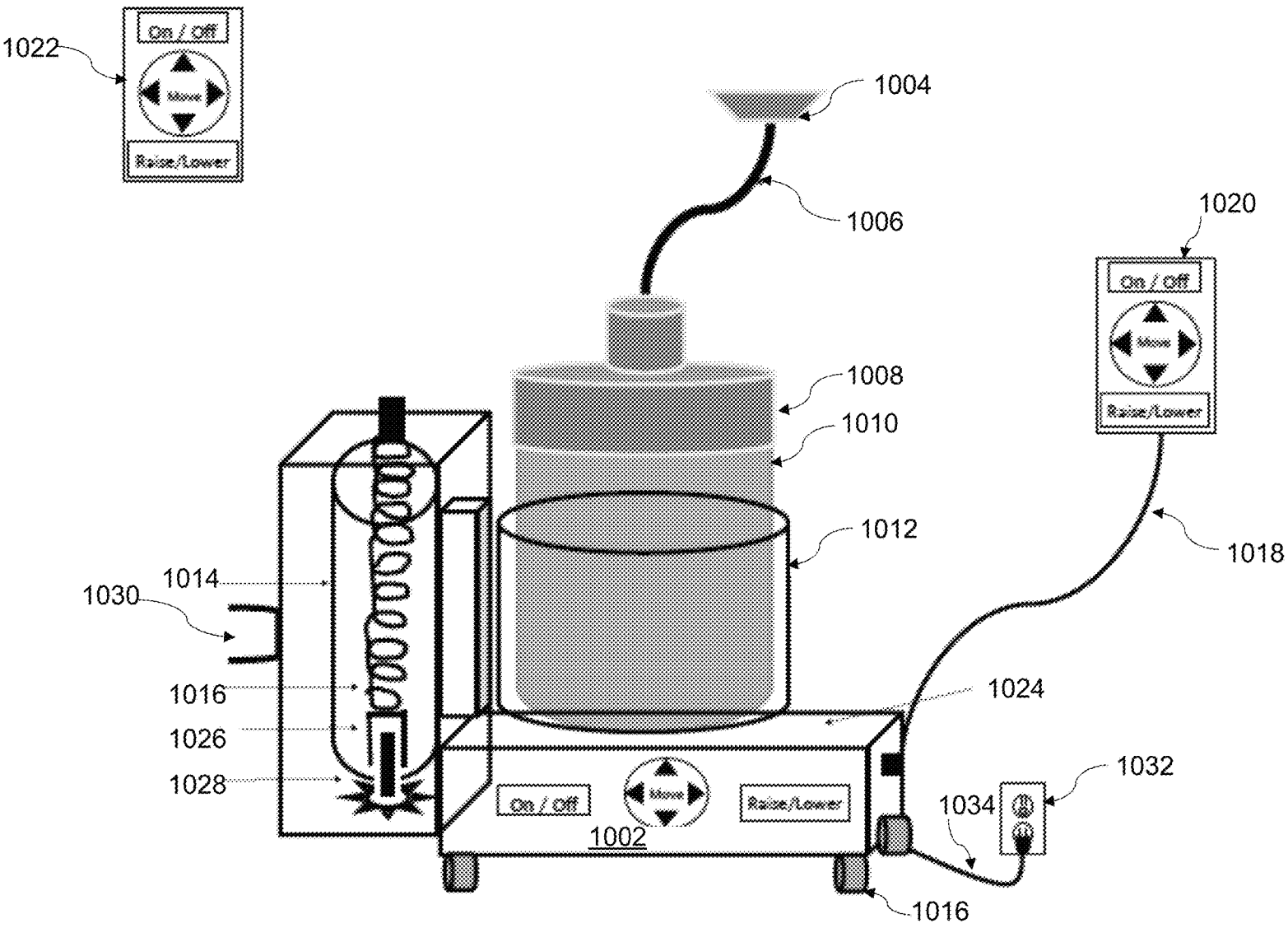
FIG. 10 depicts an exemplary embodiment of a mud supply apparatus that includes a container platform, in accordance with the disclosure.

FIG. 10 depicts an exemplary embodiment of a mud supply apparatus that includes a container platform, in accordance with the disclosure. The mud supply apparatus of FIG. 10 includes numerous components, such as: an applicator head 1004, a hose 1006 connecting the applicator head 1004 to a mud applicator 1008, a spackle bucket with mud 1010, a cylindrical container 1012, a motor base 1002, a container platform 1024 (e.g., such as a cylindrical container platform), a wireless controller 1022, a wire harness controller 1020, a lift sleeve 1014, a scaffolding stanchion bracket 1030, a screw device 1016, a female end 1026, a male end 1028, a first cord 1018, a second cord 1034, an electrical outlet 1032, and locking wheels 1016. In some examples, the controller may be housed within the container platform 1024. The locking wheels 1016 may be configured to move the container platform 1024 to a desired location and may include a locking mechanism to maintain the desired position of the container platform 1024. The container platform 1024 initially houses/holds the mud applicator 1008. The screw device 1016 interlocks with the male end 1028 and turns the screw device 1016. The lift sleeve 1014 fits through an opening in the casing that is not depicted.

Figure 11:
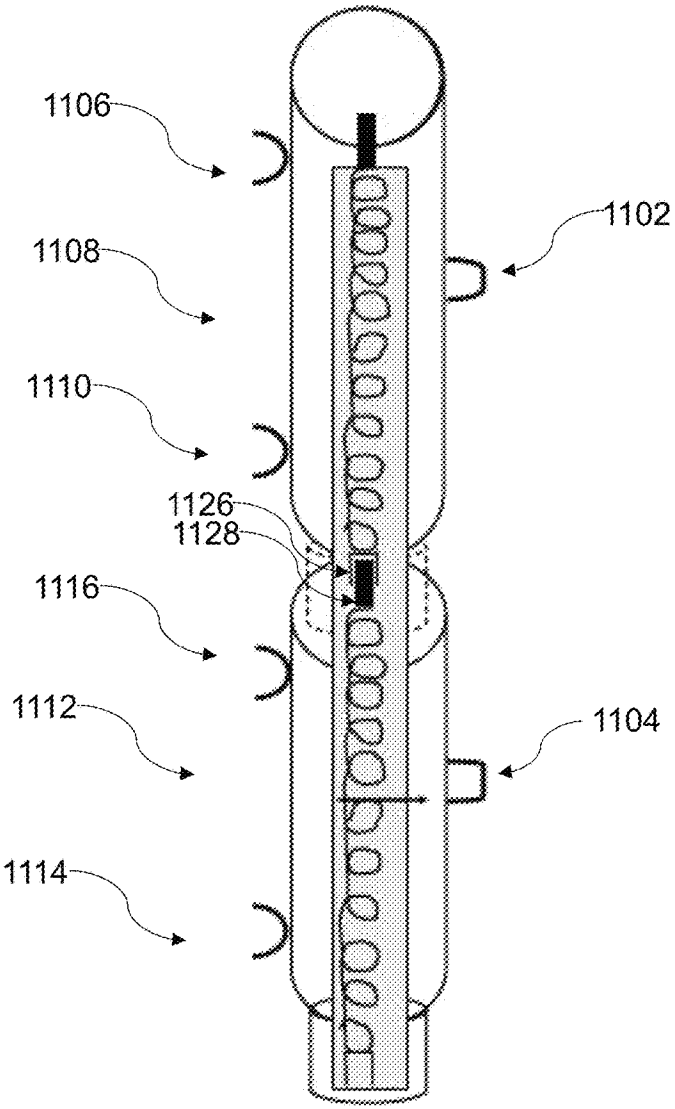
FIG. 11 depicts an exemplary embodiment of an interlocking screw device casing, in accordance with the disclosure.

FIG. 11 depicts an exemplary embodiment of an interlocking screw device casing, in accordance with the disclosure. The interlocking screw device casing of FIG. 11 includes numerous components, such as, but not limited to: a first scaffolding stanchion bracket 1102 (e.g., a first fixation component of the one or more fixation components), a second scaffolding stanchion bracket 1104 (e.g., a second fixation component of the one or more fixation components), a first screw device holder 1106, a second screw device holder 1110, a third screw device holder 1116, a fourth screw device holder 1114, a first interlocking screw device casing 1108, a second interlocking screw device casing 1112, a female end 1126, and a male end 1128.

The first interlocking screw device casing 1108 and the second interlocking screw device casing 1112 interlock to allow an appropriate quantity of sections to be connected to reach the desired elevation the mud supply apparatus will reach. It should be appreciated that two sections are depicted in FIG. 11—the first section including the first scaffolding stanchion bracket 1102, the first screw device holder 1106, the first interlocking screw device casing 1108, and the second screw device holder 1110 and the second section including the second scaffolding stanchion bracket 1104, the third screw device holder 1116, the fourth screw device holder 1114, and the second interlocking screw device casing 1112. Though two sections are depicted, the present invention is not limited to any quantity of sections.

Figure 12:
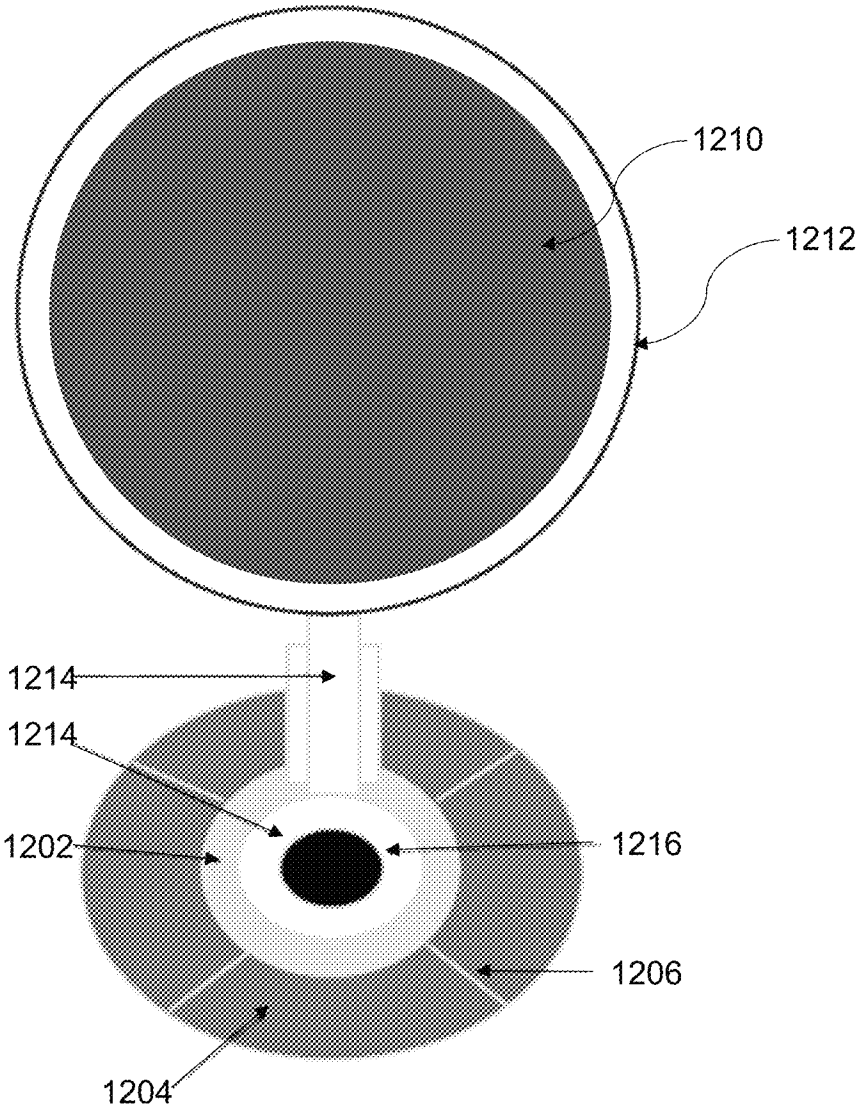
FIG. 12 depicts a top view of an exemplary embodiment of a mud supply apparatus that includes an interlocking screw device casing, in accordance with the disclosure.

FIG. 12 depicts a top view of an exemplary embodiment of a mud supply apparatus that includes an interlocking screw device casing, in accordance with the disclosure. FIG. 12 includes numerous components, such as, but not limited to, a cylindrical container 1212, a spackle bucket with a mud applicator 1210, a lift sleeve 1214, a sleeve casing 1202, a screw device interlocking casing 1204, a screw device 1216, and a casing support bracket 1206. The lift sleeve 1214 travels within the sleeve casing 1202. It should be appreciated that in some examples, two casings are not needed or necessary to the functioning of the present invention.

In some examples, the screw device 1216 is held by a bracket system in each screw device interlocking casing 1204. In other examples, an outside of the screw device interlocking casing 1204 comprises one or more holders for sections of the screw device 1216. Each section of the screw device 1216 has to be inserted into the screw device interlocking casing 1204 after the screw device interlocking casing 1204 is interlocked with one another. It should be appreciated that in other examples, the screw device 1216 may be manufactured inside of the screw device interlocking casing 1204.

Figure 13:
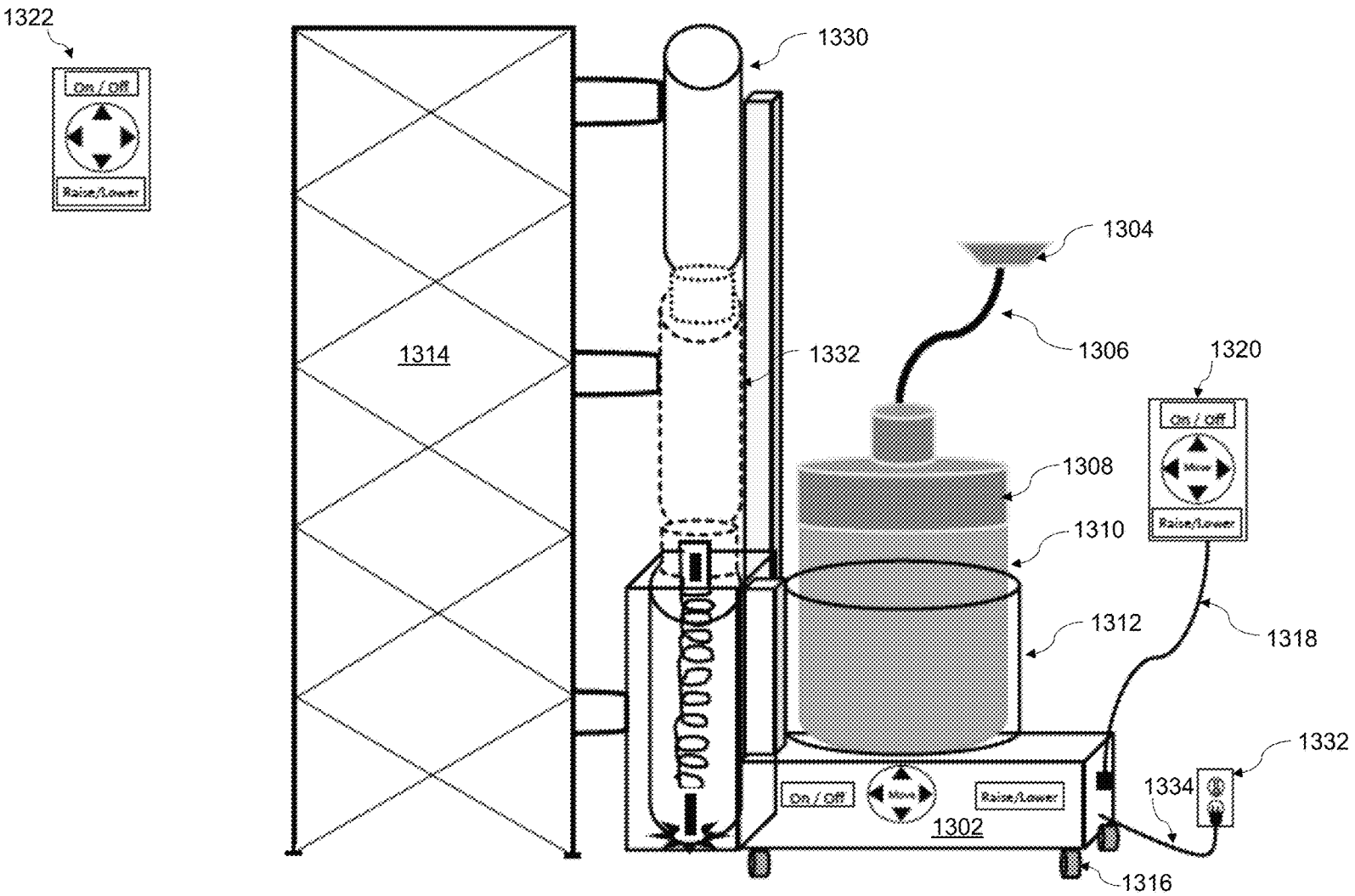
FIG. 13 depicts an exemplary embodiment of a mud applicator lift assembled with two casing sections and a motor base attached to scaffolding, in accordance with the disclosure.

FIG. 13 depicts an exemplary embodiment of a mud applicator lift assembled with two casing sections and a motor base attached to scaffolding, in accordance with the disclosure. The system of FIG. 13 includes numerous components, such as, but not limited to: an applicator head 1304, a hose 1306 connecting the applicator head 1304 to a mud applicator 1308, a spackle bucket with mud 1310, a cylindrical container 1312, a motor base 1302, a wireless controller 1322, a wire harness controller 1320, a first cord 1318, a second cord 1334, an electrical outlet 1332, locking wheels 1316, and scaffolding 1314. As shown in FIG. 13, two casing sections (e.g., a first casing section 1330 and a second casing section 1332) are used and the motor base 1302 is affixed to the scaffolding 1314. The wireless controller 1322 may be housed within the container platform 1024 (e.g., of FIG. 10).

The locking wheels described in at least FIG. 7, FIG. 8, FIG. 10, and FIG. 13 allow the container platform 1024 to be moved to a desired location and locked into place to maintain the desired location. In other examples, tracks or other movement devices may be used in place of the locking wheels. Moreover, the movement described in FIG. 7-FIG. 13 allows an operator to be on a ladder or scaffolding and operate the remote/button to raise and lower the spackle bucket with mud to allow for spackling higher areas.

In some examples, the motor base 702, 802, 1002, and 1302 of FIG. 7, FIG. 8, FIG. 10, and FIG. 13, respectively, may be motorized, allowing the motor base 702, 802, 1002, and 1302 to be moved to the desired location, while an operator is on scaffolding or a ladder. It should be appreciated that, in some examples, the motor base 702, 802, 1002, and 1302 of FIG. 7, FIG. 8, FIG. 10, and FIG. 13, respectively, is operable by any electric means. In other examples, the motor base 702, 802, 1002, and 1302 of FIG. 7, FIG. 8, FIG. 10, and FIG. 13, respectively, is operable by an LP gas system, a hydraulic system, or any other powering system known to those having ordinary skill in the art.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein. When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A system comprising:

a mud pumping apparatus comprising:

a mud pump having an inlet port and an outlet port, capable of pumping grout from the inlet port to the outlet port, a housing enclosing the mud pump, the housing having a cover portion permanently attached to a housing bottom portion, the housing bottom portion being configured to form an air-tight seal when installed onto the top of an open container of mud, the housing having a first hole through the housing bottom portion through which mud is drawn, and a second hole through a housing cover portion through which the drawn mud is pushed;

a mud pipe having two open ends, including a first end attached to the pump inlet port and a second end to be inserted into the mud container, the mud pipe configured to have a length extending from the pump inlet to a position near the bottom of the mud container when the apparatus is installed on the mud container and to draw mud from the container to the pump inlet, wherein the mud pipe is a circular auger tube;

an outlet port coupler that couples the outlet port to a mud applicator that conveys the mud to a work surface; and a container coupler that couples the housing to the open container of mud to form an air-tight seal between the bottom of the housing and the top of the open container; and a container platform comprising:

a motor comprising a movement component;

two or more wheels configured to move and lock the container platform in a desired position; and a controller configured to engage the movement component to move the mud pumping apparatus from a non-use position to an in-use position.

2. The system of claim 1, further comprising:

an auger located within the auger tube coextensive with the second end of the auger tube, the auger having a helical flute and a diameter that fits snugly within a diameter of the auger tube, the auger also having a central shank operatively coupled to a rotating motor shaft of the mud pump, the auger configured to draw mud from the container into the auger tube.

3. The system of claim 1, wherein the container coupler comprises a clamp configured to engage a lip around an external circumference of the container and to tighten against the lip to form an air-tight seal between the bottom of the housing and the open top of the container.

4. The system of claim 1, wherein the container coupler comprises a strap configured to engage an edge around a bottom circumference of the container and to tighten against the edge to form an air-tight seal between the bottom of the housing and the open top of the container.

5. The system of claim 1, further comprising an applicator removably coupled to the outlet port coupler to convey the mud to a work surface.

6. The system of claim 5, the applicator comprising an applicator head configured to extrude the mud onto the work surface to have a desired extruded cross sectional shape and size.

7. The system of claim 5, further comprising an applicator handle attached to the applicator for the user to grasp and direct extrusion of the mud onto a work surface.

8. The system of claim 1, further comprising a switch to start and stop the drawing of mud from the container to the mud pump inlet port.

9. The system of claim 1, further comprising a variable switch to variably control the volume of the mud drawn from the container to the mud pump inlet port.

10. The system of claim 1, wherein the second end of the mud pipe further comprises a threaded portion for coupling to a water hose for flushing water through the apparatus.

11. The system of claim 1, wherein the housing further comprises an inlet with a threaded end to push water into the pump to adjust viscosity of the mud during use, and for cleaning the pump.

12. A system comprising:

a mud pumping apparatus comprising:

a mud pump having an inlet port and an outlet port, capable of pumping grout from the inlet port to the outlet port, a housing enclosing the mud pump, the housing having a cover portion permanently attached to a housing bottom portion, the housing bottom portion being configured to form an air-tight seal when installed onto the top of an open container of mud, the housing having a first hole through the housing bottom portion through which mud is drawn, and a second hole through a housing cover portion through which the drawn mud is pushed;

a mud pipe having two open ends, including a first end attached to the pump inlet port and a second end to be inserted into the mud container, the mud pipe configured to have a length extending from the pump inlet to a position near the bottom of the mud container when the apparatus is installed on the mud container and to draw mud from the container to the pump inlet;

an outlet port coupler that couples the outlet port to a mud applicator that conveys the mud to a work surface; and a container coupler that couples the housing to the open container of mud to form an air-tight seal between the bottom of the housing and the top of the open container;

a container platform comprising:

a motor comprising a movement component; and two or more wheels configured to move and lock the container platform in a desired position; and a controller configured to engage the movement component to move the mud pumping apparatus from a non-use position to an in-use position.

13. The system of claim 12, wherein the movement component comprises an interlocking scissor arms component.

14. The system of claim 12, wherein the movement component comprises a telescoping component.

15. The system of claim 12, wherein the movement component comprises a screw device disposed within a lift sleeve such that the lift sleeve moves vertically along the screw device.

16. The system of claim 15, wherein the lift sleeve is affixed to scaffolding via one or more fixation components.

17. The system of claim 16, wherein the one or more fixation components comprise scaffolding stanchion brackets.

18. The system of claim 12, wherein the controller comprises a wireless controller.

19. The system of claim 12, wherein the controller is housed within the container platform.

20. The system of claim 12, wherein the controller comprises a wired controller.

* * * * *